US008974997B2

(12) United States Patent
Bachar et al.

(10) Patent No.: US 8,974,997 B2
(45) Date of Patent: Mar. 10, 2015

(54) HIGH NVS LIQUID TONER

(75) Inventors: Eyal Bachar, Nes Ziona (IL); Swissa Shay, Nes Ziona (IL); Yaron Grinwald, Nes Ziona (IL); Merav Shapira, Nes Ziona (IL); Albert Teishev, Nes Ziona (IL); Nava Klein, Nes Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 22 days.

(21) Appl. No.: 13/877,324

(22) PCT Filed: Oct. 4, 2010

(86) PCT No.: PCT/US2010/051325

§ 371 (c)(1), (2), (4) Date: Apr. 1, 2013

(87) PCT Pub. No.: WO2012/047195

PCT Pub. Date: Apr. 12, 2012

(65) Prior Publication Data

US 2013/0223887 A1 Aug. 29, 2013

(51) Int. Cl.

| | |
|---|---|
| ***G03G 9/08*** | (2006.01) |
| ***G03G 9/13*** | (2006.01) |
| ***G03G 9/125*** | (2006.01) |
| ***G03G 9/135*** | (2006.01) |

(52) U.S. Cl.

CPC ..... *G03G 9/131* (2013.01); *G03G 9/125* (2013.01); *G03G 9/132* (2013.01); *G03G 9/133* (2013.01); *G03G 9/135* (2013.01)

USPC ..... 430/114; 430/137.22

(58) Field of Classification Search

CPC ..... G03G 9/135

USPC ..... 430/114, 137.22

See application file for complete search history.

(56) References Cited

U.S. PATENT DOCUMENTS

| | | | | |
|---|---|---|---|---|
| 5,451,483 | A | 9/1995 | Fuller et al. | |
| 6,146,803 | A | 11/2000 | Landa et al. | |
| 6,692,881 | B2 | 2/2004 | Tsubuko et al. | |
| 6,806,013 | B2 | 10/2004 | Morrison et al. | |
| 6,861,193 | B1 * | 3/2005 | Golodetz | 430/114 |
| 6,897,002 | B2 | 5/2005 | Teraoka et al. | |
| 7,259,193 | B2 | 8/2007 | Yon et al. | |

(Continued)

FOREIGN PATENT DOCUMENTS

| | | |
|---|---|---|
| CN | 101523302 | 9/2009 |
| JP | 2000336291 | 12/2000 |

(Continued)

OTHER PUBLICATIONS

International Search Report for PCT/US2010/051325, dated Jul. 1, 2011, for Applicant Hewlett-Packard Development Company, L.P. et al.

*Primary Examiner* — Mark A Chapman

(74) *Attorney, Agent, or Firm* — Thorpe, North & Western L.L.P.

(57) ABSTRACT

The present disclosure is drawn to LEP toners, systems, and methods of manufacturing LEP liquid toners. Specifically, a high NVS liquid toner can comprise a ground up admixture of a hydrocarbon carrier fluid, pigment particles, and a polymer paste having an NVS content of about 38 wt % to about 65 wt %. The resultant high NVS liquid toner has an NVS content of about 28 wt % to about 38 wt % and a viscosity of about 3,000 cPs to about 25,000 cPs.

17 Claims, 2 Drawing Sheets

(56) References Cited

U.S. PATENT DOCUMENTS

| | | | | |
|---|---|---|---|---|
| 7,736,828 | B2 | 6/2010 | Regev et al. | |
| 2002/0102487 | A1 | 8/2002 | Almog | |
| 2010/0047700 | A1 * | 2/2010 | Teishev et al. | 430/18 |

FOREIGN PATENT DOCUMENTS

| | | |
|---|---|---|
| KR | 100301325 | 10/2001 |
| WO | 2006131905 | 12/2006 |
| WO | 2008054386 | 5/2008 |

* cited by examiner

HIGH NVS LIQUID TONER

BACKGROUND

Digital printing involves technologies in which a printed image is created directly from digital data, for example using electronic layout and/or desktop publishing programs. Methods of digital printing include full-color ink-jet printing, electrophotographic printing, laser photo printing, and thermal transfer printing methods.

Electrophotographic printing techniques involve the formation of a latent image on a photoconductor surface mounted on an imaging plate or other surface. In one instance, the photoconductor is first sensitized, usually by charging, and then exposed to light projected through a positive film of the document to be reproduced, resulting in dissipation of the charge in the areas exposed to light. The latent image is subsequently developed into a full image by the attraction of oppositely charged toner particles to the charge remaining on the unexposed areas. The developed image is transferred from the photoconductor to a hot elastomeric blanket, from which it is transferred to a substrate, such as paper, plastic or other suitable material, by heat or pressure or a combination of both to produce the printed final image.

The latent image is developed using, either a dry toner (a colorant mixed with a powder carrier) or a liquid ink (a suspension of a pigmented resin in a liquid carrier). The toner or ink generally adheres to the substrate surface with little penetration into the substrate. The quality of the final image is largely related to the size of the particles, with higher resolution provided by smaller particles. Further, it can sometimes be desirable to have toner concentrations with relatively high solids content, however the manufacture liquid toner compositions with high solids content toners is challenging.

DETAILED DESCRIPTION

Figure 1:
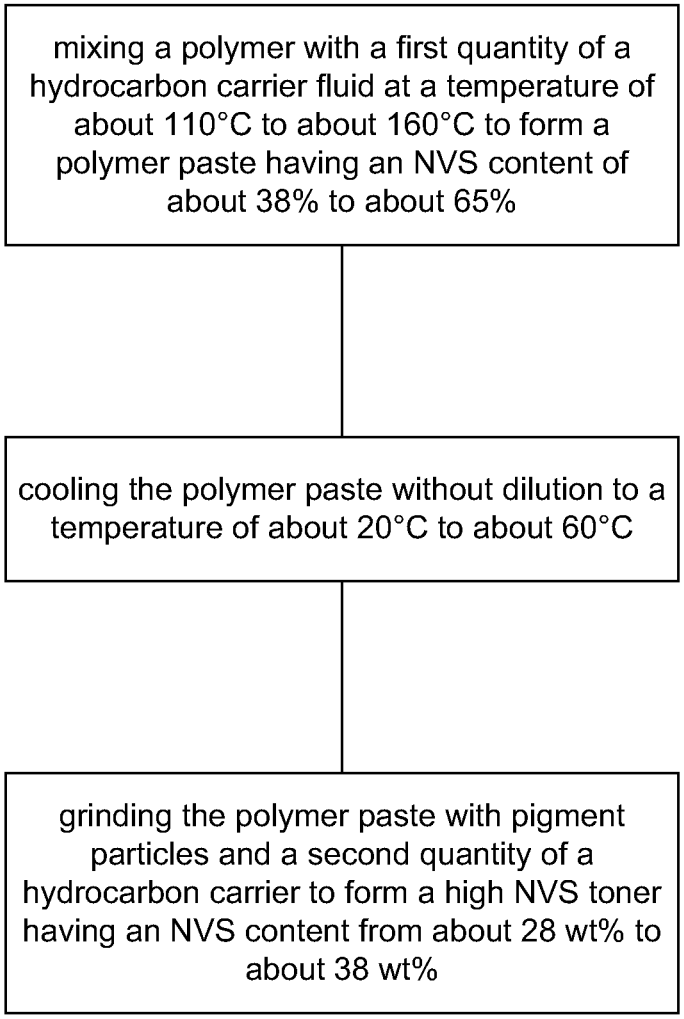
FIG. 1 is a flow diagram of a method in accordance with an example of the present disclosure.

It is to be understood that this disclosure is not limited to the particular process steps and materials disclosed herein because such process steps and materials may vary somewhat. It is also to be understood that the terminology used herein is used for the purpose of describing particular embodiments only.

The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "carrier liquid," "carrier," or "carrier vehicle" refers to the fluid in which a liquid toner of the present disclosure can be dispersed to form a liquid electrophotographic ink. Such carrier liquids and vehicle components are known in the art. Typical carrier liquids can include a mixture of a variety of different agents, such as surfactants, co-solvents, viscosity modifiers, and/or other possible ingredients. The carrier liquid can, but does not need to include, the hydrocarbon carrier fluid used in the manufacture of the LEP toner.

As used herein, "liquid electrophotographic toner" generally refers to a toner composition having a hydrocarbon carrier fluid, a polymer, and a pigment.

As used herein, "pigment" generally includes colorless or colored pigment particles. Typically, the pigment is a pigment colorant. Though the present description primarily exemplifies the use of pigment colorants, the term "pigment" can be used more generally to describe not only pigment colorants, but other pigments such as organo-metallics, ferrites, ceramics, etc.

As used herein, "non-volatile solids" and "NVS" are used interchangeably and refer to the solids content of compositions of both manufacturing intermediates and toner compositions described herein. NVS components can include, but are not limited to, polymers or resins, silica, wax, and pigments, as well asnon volatile additives, such as lecithin, basic barium petronate, calcium petronate, and amine salts, which remain in the solid film after evaporating the carrier liquid. A toner composition that is described as "a high NVS toner" is a toner composition that has greater non-volatile solids content than is typically present in LEP toners. For example, "high NVS" toners include toners that have a minimum of about 28 wt % non-volatile solids. In one embodiment, the high NVS toners can include a minimum of about 30 wt % non-volatile solids.

As used herein, "electrophotographic printing" generally refers to the process that provides an image that is transferred from a photo imaging substrate either directly, or indirectly, via an intermediate transfer member. Typically, the image is not absorbed into the substrate on which it is applied. Additionally, "electrophotographic printer" generally refers to those printers capable of performing electrophotographic printing, as described above. "Liquid electrophotographic printing" is a specific type of electrophotographic printing where a liquid ink is employed in the electrophotographic process rather than a dry powder toner.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

It has been recognized that it would be advantageous to develop a liquid electrophotographic toner having increased non-volatile solids (NVS) content. In accordance with this, the present disclosure is drawn to high NVS liquid toners as well as methods of making toner compositions having high NVS content. It is noted that when discussing a high NVS liquid electrophotographic toners or a method of making the same, each of these discussions can be considered applicable to each of these embodiments, whether or not they are explicitly discussed in the context of that embodiment. Thus, for example, in discussing a polymer incorporated into a polymer used in the manufacture of the liquid electrophotographic toner, such discussion also refers to the polymer that can be used in the toners themselves, and vice versa.

With these definitions in mind, a high NVS liquid toner can comprise a ground up admixture of a hydrocarbon carrier fluid, pigment particles, and a polymer paste having an NVS content of about 38 wt % to about 65 wt %. The ground up admixture results in a high NVS liquid toner can have an NVS content of about 28 wt % to about 38 wt % and a viscosity of about 3,000 cPs to about 25,000 cPs. More specifically, the polymer paste can include polymer admixed with a first quantity of a hydrocarbon carrier fluid, and the high NVS liquid toner can also include the polymer paste admixed with a second quantity of a hydrocarbon carrier fluid.

Additionally, a printing system is provided that includes a liquid electrophotographic printing device and an LEP ink. The LEP ink can include about 1 wt % to about 8 wt % of the high NVS liquid toner disclosed herein and about 92 wt % to about 99 wt % of a liquid vehicle. In one embodiment, the liquid toner is present at about 1 wt % to about 3 wt % of the LEP ink. The LEP printing device can be utilized so that the liquid toner is combined with the liquid vehicle during or shortly before printing via the printing device.

In accordance with another embodiment, and as shown generally in FIG. 1, a method of producing a high NVS toner for use in liquid electrophotographic printing is provided. The method includes mixing a polymer with a first quantity of a hydrocarbon carrier fluid at a temperature of about 110° C. to about 160° C. to form a polymer paste having an NVS content of about 38% to about 65%. In one embodiment, the polymer paste can have an NVS content of about 38 wt % to about 50 wt %. The polymer paste is then cooled, without dilution, to a temperature of about 20° C. to about 60° C. The polymer paste, pigment particles, and a second quantity of a hydrocarbon carrier fluid are then ground to form the high NVS toner. The toner can have a final NVS content of about 28 wt % to about 38 wt %. In another embodiment, the toner can have an NVS content of about 30 wt % of about 35 wt %.

The temperatures and ordering of the steps of the toner manufacturing method are used in accordance with embodiments of the present disclosure in order to achieve the high NVS content of the final product. As discussed above, the method includes the initial step of heating and mixing a polymer and a hydrocarbon carrier fluid together at a temperature of about 110° C. to 140° C. The heating and mixing can be for a period of about 15 minutes to 4 hr, although about 1 hr is represents an exemplary typical time period. The heating process allows the polymer to become solvated or dispersed in the hydrocarbon carrier fluid and forms a polymer paste. The polymer paste is then cooled, without diluting, to about room temperature, e.g., about 20° C. to about 60° C. By cooling without diluting with additional hydrocarbon carrier fluid, the NVS content of the polymer paste is allowed to remain high, e.g., about 38 wt % to about 65 wt %.

Following cooling, the high NVS cooled polymer paste can then be placed in a grinder with pigment and additional hydrocarbon carrier fluid. In one embodiment, the grinding step can occur at a temperature of about 20° C. to about 60° C. As a more specific example, the grinding can be carried out on the polymer paste, pigment, and additional hydrocarbon carrier fluid for about 6-10 hr at 58° C. followed by a period of grinding of about 44 to 48 hr at a temperature of about 45° C.

By adding additional hydrocarbon carrier fluid during the grinding step, but after the cooling of the polymer paste, the presently disclosed method allows the grinding to occur at a lower viscosity, while at the same time still achieving the increased NVS content of the toner. It is noteworthy that the additional hydrocarbon carrier used in the grinding step can be, but does not have to be, the same hydrocarbon carrier fluid that is used in the formation of the polymer paste. The amount of additional hydrocarbon carrier fluid added during the grinding step can be such that it makes up about 3 wt % to about 15 wt % of the finished toner composition, in one embodiment.

The hydrocarbon carrier fluid (either the first quantity that is used to form the paste or the second quantity that is used to further dilute the toner) can be independently selected from any hydrocarbon carrier fluid known in the art that is suitable for use in LEP printing. Generally, the hydrocarbon carrier fluid acts as a dispersing medium for the other components in the liquid electrophotographic toners. In one embodiment, the hydrocarbon carrier fluid can be a $C_6$ to $C_{20}$ hydrocarbon. In another embodiment, the hydrocarbon carrier fluid can include a paraffin or isoparaffin. Examples of isoparaffin liquids that can be used include ISOPAR® high-purity isoparaffinic solvents with narrow boiling ranges marketed by Exxon Mobil Corporation (Fairfax, Va., USA). Also suitable as carrier liquids or components of carrier liquids for implementing embodiments of the present disclosure are alkanes having from about 6 to about 14 carbon atoms such as solvents sold under the NORPAR® (NORPAR® 12, 13 and 15) tradename available from Exxon Mobil Corporation (Fairfax, Va., USA). Other hydrocarbons for use as carrier liquids or vehicle components are sold under the AMSCO® (AMSCO® 460 and OMS) tradename available from American Mineral Spirits Company (New York, N.Y., USA), under the SOLTROL® tradename available from Chevron Phillips Chemical Company LLC (The Woodlands, Tex., USA) and under the SHELLSOL® tradename available from Shell Chemicals Limited (London, UK). Such carrier liquids and vehicle components have desirable properties such as low odor, lack of color, selective solvency, good oxidation stability, low electrical conductivity, low skin irritation, low surface tension, superior spreadability, narrow boiling point range, non-corrosive to metals, low freeze point, high electrical resistivity, high interfacial tension, low latent heat of vaporization and/or low photochemical reactivity.

The toners disclosed herein can be made using a variety of pigments and pigment colorants, including black pigments, cyan pigments, magenta pigments, yellow pigments, essentially colorless pigments, and combinations thereof. Generally, the pigments can be of any variety known to be useful in the electrophotographic printing fields. Non-limiting examples of pigments that can be used in the toners include pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3G, CROMOPHTHAL® YELLOW GR, CROMOPHTHAL® YELLOW 8G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 6901 F, HELIOGEN® BLUE TBD 7010, HELIOGEN® BLUE K 7090, HELIOGEN® BLUE L 7101F, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200.

The polymer used in the toners disclosed herein can generally be any polymer or co-polymer useful in the printing arts. The polymers and copolymers of the present disclosure can be prepared through polymerization mechanisms. For example, the polymers and copolymers described herein can be prepared by a conventional free radical addition. Further, the polymer can comprise from about 80 wt % to about 90 wt % of the total NVS of the toner compositions. The polymer can be a single polymer or copolymer or it can be a mixture of polymers or copolymers. Non-limiting examples of polymers that can be used in the toner compositions of the present disclosure include acrylate polymers and copolymers, maleic anhydride modified polyethylene, maleic anhydride grafted polypropylene copolymer, maleic anhydride grafted linear ethylene acetate polymer, ethylene methacrylic acid copolymers and their ionomers, ethylene acrylic acid copolymers and their ionomers, polyamides, ethylene-vinyl acetate(EVA) copolymers; copolymers of ethylene and an ethylenically unsaturated acid of either acrylic acid and methacrylic acid; copolymers of ethylene, acrylic or methacrylic acid/alkyl ester of methacrylic or acrylic acid; polyethylene; polystyrene; crystalline polypropylene; ethylene ethyl acrylate;

ethylene methacrylic acid copolymers which are partially neutralized with metal ions (e.g. Zn, Na, Li) such as SURLYN® ionomers; acid modified ethylene vinyl acetate terpolymer or blends thereof; polyesters; polyvinyl toluene; polyamides; styrene/butadiene copolymers; ethylene and an ethylenically unsaturated acid of either acrylic or methacrylic acid; an ester of ethylene methacrylic acid copolymer and an acid modified ethylene vinyl acetate terpolymer; ethylene and an ethylenically unsaturated acid of either acrylic or methacrylic acid. In one embodiment, the polymer can be a NUCREL® polymer, such as NUCREL® 925, NUCREL® 2906, NUCREL® 2806, NUCREL® 699, NUCREL ® 599, or NUCREL® 960. In one embodiment, the polymer can include a polyethylene-acrylic acid copolymer, ethylene acrylic acid copolymers, polystyrene, polyethylene, ethylene methacrylic acid copolymers, and combinations thereof.

The toner compositions can further include a wax. In one embodiment, the wax can be added to the polymer paste, pigment particles, and additional hydrocarbon for the grinding step of the manufacturing process. In one embodiment, the wax can be wax particles that have been treated with a charge adjuvant to increase their susceptibility to charging by a charge director. When present, in one embodiment, the wax can comprise about 3 wt % to about 7 wt % of the NVS content of the toner. Any wax known in the art can be used so long as it is compatible with the other components of the toner. In one embodiment, the wax can be a polyethylene wax.

The toners can also include a charge director. The charge director can be added to the toners in order to maintain sufficient electrostatic charge of the toner particles for effective electrostatic printing. In one specific embodiment, the charge director can include aluminum tri-stearate. In another embodiment, the charge director can include lecithin, basic barium petronate and calcium petronate, or an amine salt, etc. When present, the charge director can be added to the toner for grinding step. Additionally, in one embodiment, a charge director can be added to and ground with a wax prior to the addition of the wax and the charge director to the other components of the toner.

The toner compositions of the present disclosure can further include silica. In one embodiment, the silica can be dispersed in the polymer or within the toner. When present, the silica can comprise about 1 wt % to about 5 wt % of the NVS of the toner. In a more detailed example, the silica can be activated silica. In another example, the silica can have a methacryl propyl trimethoxy silane functionality.

EXAMPLES

The following examples illustrate embodiments of the example that are presently known. Thus, these examples should not be considered as limitations of the present example, but are merely in place to exemplify how to make compositions described herein. As such, a representative number of compositions and their method of manufacture are disclosed herein.

Example 1

Production of LEP Toner with High NVS Content 750 grams of polyethylene-acrylic acid co-polymer (NUCREL 0 669,DuPont®) is mixed in a Ross double planetary mixer with 1750 grams of ISOPAR® L (an iso-parfinic oil manufactured by EXXON®) carrier liquid at a speed of 60 rpm and a temperature of 130° C. for 1 hr. The temperature is then reduced and mixing is continued until the mixture reaches room temperature. During the cooling, granules of polymer (with solvated carrier liquid) in carrier are produced to form a polymer paste.

Next, 1500 grams of the polymer paste is then charged into a Union process 1S ball attritor together with 10 grams of aluminum tri-stearate as a charge adjuvant and 65 grams of pigment blue 15:3 pigment (Toyo Ink), and 700 more grams of ISOPAR® L. The mixture is ground for 2 hr at 55° C. followed by grinding for 10 hr at 40° C. until a toner concentrate having toner particles incorporating the adjuvant and pigments is produced. It is noted that optionally, 10 grams of silica can also be added for grinding with the mixture.

Example 2

Production of High NVS Cyan Toner 49.5 Kg of polyethylene-acrylic acid co-polymer (NUCREL 669, DuPont) is mixed in a Ross 40 double planetary mixer with 60.5 Kg of ISOPAR® L (an iso-parfinic oil manufactured by EXXON) carrier liquid at a speed of 60 rpm and a temperature of 130° C. for 1 hr. The temperature is then reduced and mixing is continued until the mixture reaches room temperature. During the cooling, granules of polymer with a carrier liquid are produced. The polymer paste has an NVS content of about 41.9 wt %.

Next, 37.8 Kg of the polymer paste is charged into a Union process CTR Q-6 ball attritor together with 0.77 Kg of aluminum tri-stearate as a charge adjuvant, 2.93Kg of pigment blue 15:3 pigment (Toyo Ink), and 31.71 Kg of ISOPAR® L. Where silica is desired for inclusion, 0.45Kg of silica is added. Where HPB is desired for inclusion, 1.35 Kg of HPB is added. The mixture is ground for 8 hr at 58° C. and then ground for 46 hr at 45° C. until a toner concentrate having toner particles incorporating the adjuvant and pigments is produced.

Example 3

Production of High NVS Black Toner 49.5 Kg of polyethylene-acrylic acid co-polymer (NUCREL 669,DuPont) is mixed in a Ross 40 double planetary mixer with 60.5 Kg of ISOPAR® L (an iso-parfinic oil manufactured by EXXON®) carrier liquid at a speed of 60 rpm and a temperature of 130° C. for 1 hr. The temperature is then reduced and mixing is continued until the mixture reaches room temperature. During cooling, granules of polymer with carrier liquid are produced as a polymer paste.

Next, 365.24 Kg of the polymer paste is charged into a Union process CTR Q-100 ball attritor together with 2.52 Kg of aluminum tri-stearate as a charge adjuvant, 31.43Kg of pigment black (Mon-800 Ink), and 281.79 Kg of ISOPAR® L. Where HPB is desired for inclusion, 12.61 Kg of HPB is added. The mixture is ground for 8 hr at 58° C. followed by grinding for 46 hr at 45° C. until a toner concentrate having toner particles incorporating the adjuvant and pigments is produced.

Example 4

Production of Comparative High NVS Cyan Paste by Concentrating Lower NVS Content Polymer Paste 750 grams of polyethylene-acrylic acid co-polymer (NUCREL 699, E. I. Du Pont de Nemours and Company, Wilmington, Del) is mixed in a ROSS double planetary mixer (Charles Ross & Son Co., Hauppauge, N.Y.) with 1750 grams of ISOPAR® L (an iso-parfinic oil manufactured by Exxon Mobile Corp. in Irving, Tex.) carrier liquid at a speed of 60 rpm and a temperature of 130° C. for 1 hr. The temperature is then reduced and mixing is continued until the mixture reaches room temperature. During cooling, granules of polymer (with solvated carrier liquid) in carrier liquid are produced. The polymer paste has an NVS content of about 25 wt %. In order to get the paste to a higher NVS content, the paste was dried slowly at a low temperature in order to not damage the solids present in the paste while driving off a portion of the solvent until the NVS content was at approximately 41.9 wt %.

Example 5

Viscosity Testing Procedures for Testing Viscosities of Polymer Pastes used in LEP Toner Manufacture The viscosity of the polymer pastes used in the production of LEP toners can be tested according to the following methodology. A rheometer, such as Model: AR 2000 and the software Rheology advantage data analysis V5.1.42 can be used to measure flow properties like viscosity, modulus, compliance, of materials and their components by comparing the apparent viscosity from the amplitudes of the input and output signals yields. A controlled stress (strain) Rheometer applies a rotational stress (displacement) to a sample held between two parallel plates and measures its resulting movement (force). The Rheometer can also be used as a viscometer, by applying the stress in a steady direction. Stress-Strain curves from viscometer measurements can be used to classify the type of flow the fluid undergoes, and to determine flow properties. For example, if the fluid is Newtonian, the Newtonian viscosity can be determined.

When the input stress is applied, sinusoidal, complex, real, and imaginary components can be determined for the flow properties. This mode of operation yields more information about viscoelastic materials (those that evidence mixed solid-like and liquid like behavior) than viscometer. As before, comparing the amplitudes of the input and output signals yields the viscosity, but sample motion lags behind the input stress. The extent of the lag defines the phase angle, allowing the viscosity to separate into real and imaginary components. Similarly, complex, real, and imaginary values for modulus and compliance can be calculate.

Electrically heated plates surrounding the sample allow these measurements to be taken as a function of temperature. Typical studies involving temperature control are determined for temperature variation in flow properties (usually near room temperature), examination of cure processes, and to examine the flow properties of polymer melts. Sometimes, it can be desirable to determine viscoelastic properties at extremely low frequencies that are too low for direct measurements to be practical. For example, 0.001 Hz would require 1000 seconds for each cycle. Properties at very low frequencies can be inferred from other test data, which has been analyzed using time-temperature superposition software, to generate theoretical curves (See Example 6 and FIG. 2).

Example 6

Viscosity Testing of Polymer Pastes used in LEP Toner Manufacture

Figure 2:
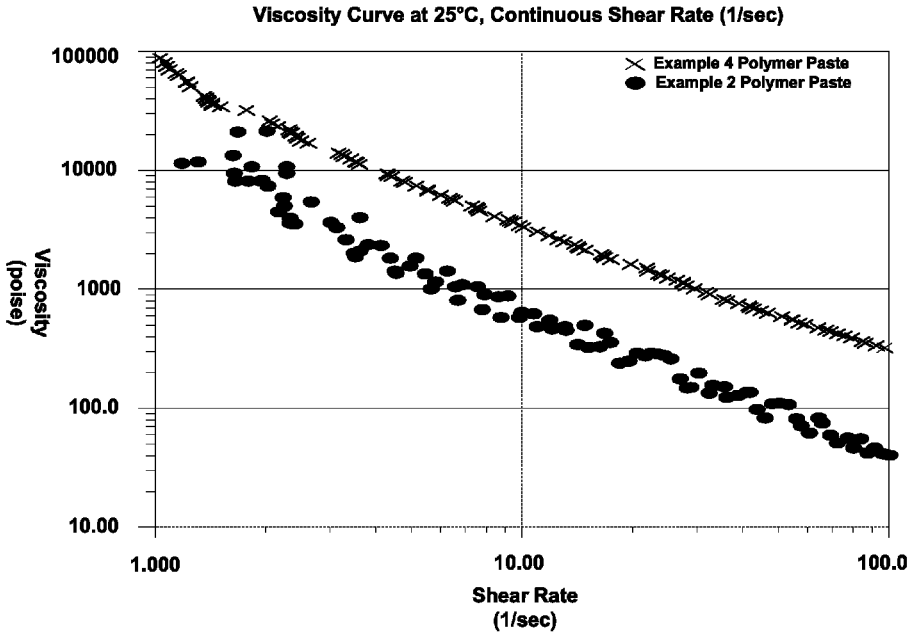
FIG. 2 is a plot of the viscosity versus shear rate of polymer paste used for the manufacture of high NVS toners of the present disclosure compared to a polymer paste manufactured using another method.

The viscosities of the polymer pastes of Examples 2 and 4 were tested for their respective properties useful for grinding with pigment and hydrocarbon solvent. The viscosities were measured with a rheometer using two different methods. Each method used a rheometer having parallel plate with a gap of 500 μm. In Method 1, the temperature was about 25° C., the rheometer was set to flow mode, and there was a continuous shear rate. In Method 2, the temperature was about 25° C., the rheometer was set to oscillation mode, and there was controlled oscillation stress of about 3000 and a frequency of about 10 Hz. The results of testing on the Example 2 polymer paste and Example 4 polymer paste are shown in FIG. 2. As can be seen from FIG. 2, the polymer paste of Example 2 prepared in accordance with a method of the present disclosure has reduced viscosity at comparable shear rates than the comparative polymer paste of Example 4.

While the example has been described with reference to certain embodiments, those skilled in the art will appreciate that various modifications, changes, omissions, and substitutions can be made without departing from the spirit of the example. It is intended, therefore, that the example be limited only by the scope of the following claims.

What is claimed is:

1. A high NVS liquid toner, comprising a ground up admixture of a hydrocarbon carrier fluid, pigment particles, and a polymer paste having an NVS content of about 38 wt % to about 65 wt %, wherein the high NVS liquid toner has an NVS content of about 28 wt % to about 38 wt % and a viscosity of about 3,000 cPs to about 25,000 cPs.

2. The high NVS liquid toner of claim 1, wherein the polymer paste includes polymer admixed with a first quantity of a hydrocarbon carrier fluid, and the NVS liquid toner further includes a second quantity of a hydrocarbon carrier fluid.

3. The high NVS liquid toner of claim 2, wherein the first quantity of the hydrocarbon carrier fluid and the second quantity of the hydrocarbon carrier fluid is the same hydrocarbon carrier fluid.

4. The high NVS liquid toner of claim 2, wherein the first quantity of the hydrocarbon carrier fluid and the second quantity of the hydrocarbon carrier fluid are a different hydrocarbon carrier fluids.

5. The high NVS liquid toner of claim 2, wherein the first quantity of the hydrocarbon carrier fluid and the second quantity of the hydrocarbon carrier fluid are independently selected from the group consisting of paraffins, isoparaffins, $C_6$-$C_{20}$ alkanes, and combinations thereof.

6. The high NVS liquid toner of claim 2, wherein the polymer is selected from the group consisting of polyethylene-acrylic acid copolymer, ethylene acrylic acid copolymers, polystyrene, polyethylene, ethylene methacrylic acid copolymers, and combinations thereof.

7. A printing system, comprising a liquid electrophotographic printing device loaded with from about 1 wt % to about 8 wt % of the high NVS liquid toner of claim 1 and about 92 wt % to about 99 wt % of a liquid vehicle.

8. A method of producing a high NVS toner for liquid electrophotographic printing, comprising:

mixing a polymer with a first quantity of a hydrocarbon carrier fluid at a temperature of about 110° C. to about 160° C. to form a polymer paste having an NVS content of about 38% to about 65%;

cooling the polymer paste without dilution to a temperature of about 20° C. to about 60° C.; and grinding the polymer paste with pigment particles and a second quantity of a hydrocarbon carrier to form a high NVS toner having an NVS content from about 28 wt % to about 38 wt %.

9. The method of claim 8, wherein the high NVS toner includes a wax as part of the NVS content.

10. The method of claim 9, wherein the wax includes wax particles treated with a charge adjuvant.

11. The method of claim 8, wherein the high NVS toner includes a charge director as part of the NVS content.

12. The method of claim 8, wherein the high NVS toner includes silica as part of the NVS content.

13. The method of claim 12, wherein the silica includes silica selected from the group consisting of activated silica, silica having a methacryl propyl trimethoxy silane functionality, and combinations thereof.

14. The method of claim 8, wherein the high NVS toner has an NVS content of about 30 wt % to about 35 w %.

15. The method of claim 8, wherein the first quantity of the hydrocarbon carrier fluid and the second quantity of the hydrocarbon carrier fluid is independently selected from the group consisting of paraffins, isoparaffins, $C_6$-$C_{20}$ alkanes, and combinations thereof.

16. The method of claim 8, wherein the polymer is selected from the group consisting of polyethylene-acrylic acid copolymer, ethylene acrylic acid copolymers, polystyrene, polyethylene, ethylene methacrylic acid copolymers, and combinations thereof.

17. The method of claim 8, wherein the high NVS toner has a viscosity of about 3,000 cPs to about 25,000 cPs.

* * * * *